US007350618B2

(12) United States Patent
Goh et al.

(10) Patent No.: US 7,350,618 B2
(45) Date of Patent: Apr. 1, 2008

(54) MULTIMEDIA SPEAKER PRODUCT

(75) Inventors: Aik Hee Goh, Singapore (SG); Susimin Suprapmo, Singapore (SG); Kar Choon Ng, Singapore (SG)

(73) Assignee: Creative Technology Ltd, Singapore (SG)

( * ) Notice: Subject to any disclaimer, the term of this patent is extended or adjusted under 35 U.S.C. 154(b) by 231 days.

(21) Appl. No.: 10/907,468

(22) Filed: Apr. 1, 2005

(65) Prior Publication Data

US 2006/0219474 A1 Oct. 5, 2006

(51) Int. Cl.
*G10K 11/02* (2006.01)
*H04R 1/28* (2006.01)

(52) U.S. Cl. ..... 181/156; 181/144; 181/145; 181/147; 181/148; 181/179; 181/189; 181/196; 181/197; 181/199; 381/351; 381/353; 381/386; 381/387

(58) Field of Classification Search ..... 181/156, 181/148, 198, 199, 144, 145, 147, 179, 186, 181/196, 197, 189; 381/335, 24, 386, 387, 381/351, 353, 151
See application file for complete search history.

(56) References Cited

U.S. PATENT DOCUMENTS

| | | | | | |
|---|---|---|---|---|---|
| 2,193,399 | A | * | 3/1940 | Fisher | 181/160 |
| 3,826,333 | A | * | 7/1974 | Buckwalter | 181/153 |
| 3,961,684 | A | * | 6/1976 | Michael et al. | 181/143 |
| 4,139,734 | A | | 2/1979 | Fincham | |
| 4,441,577 | A | | 4/1984 | Kurihara | |
| 4,884,655 | A | * | 12/1989 | Freadman et al. | 181/145 |
| 4,932,060 | A | | 6/1990 | Schreiber | |
| 5,025,885 | A | | 6/1991 | Froeschle | |
| 5,092,424 | A | | 3/1992 | Schreiber | |
| 5,222,145 | A | * | 6/1993 | Draffen | 381/307 |
| 5,471,019 | A | | 11/1995 | Maire | |
| 5,550,921 | A | * | 8/1996 | Freadman | 381/300 |
| 5,751,821 | A | * | 5/1998 | Smith | 381/332 |
| 5,887,068 | A | * | 3/1999 | Givogue et al. | 381/89 |
| 6,389,146 | B1 | | 5/2002 | Croft, III | |
| D487,075 | S | * | 2/2004 | Dayan | D14/216 |
| 7,036,781 | B1 | * | 5/2006 | Bothe | 248/291.1 |
| 7,136,498 | B1 | * | 11/2006 | Schott | 381/351 |
| 2002/0061114 | A1 | * | 5/2002 | Croft, III | 381/345 |

* cited by examiner

*Primary Examiner*—Lincoln Donovan
*Assistant Examiner*—Jeremy Luks
(74) *Attorney, Agent, or Firm*—Russell N. Swerdon

(57) ABSTRACT

A satellite speaker system includes a side firing low mid driver mounted in a sub-enclosure which is vented into a second sub-enclosure through an acoustic resistance vent and to a third sub-enclosure through a variable aperture second vent. The vents further serve as pivots to allow the side-firing speaker to be rotated through a predetermined range, simultaneously varying the aperture of the second vent. The pivots are isolated by o-rings to provide an airtight seal to the sub-enclosures, as well as to provide vibration control. Third, fourth and fifth resistively damped vents allow the first and second sub-enclosure to establish acoustic communication with the environment. The front firing driver/s that reproduces the mid and high frequencies are mounted in a fourth sub-enclosure.

19 Claims, 5 Drawing Sheets

MULTIMEDIA SPEAKER PRODUCT

FIELD OF THE INVENTION

The present invention relates to speaker enclosures. More particularly, the present invention relates to speaker systems having pivoting speaker enclosures.

BACKGROUND OF THE INVENTION

Modern speaker designs strive for optimal solutions in satisfying the often-conflicting objectives of high playback levels, high quality, as well as compactness. Audio playback quality, in particular, may be further enhanced by providing flexibility in the speaker configuration to adapt to different listening environment acoustics and setups.

One known method of adjusting speaker characteristics to suit the listening environment involves pivoting enclosures. These speaker systems typically involve a mid or high frequency driver provided in an enclosure adjustable relative to a second enclosure housing a low frequency driver. These systems typically allow pivoting or tilting relative to the low frequency driver to directionally aim the high frequency sound towards the listener. Since low frequency units are generally omni directional in radiation, the listening experience is unaffected by the orientation of the low frequency enclosure.

Unfortunately, the low frequency units are typically also oriented towards the listener. The low frequency units not only radiate low frequency audio, but also some unintended higher frequency sounds. These are generally referred to as distortion products.

What is desired is an improved speaker system that reduces or eliminates distortion products from the listening axis.

SUMMARY OF THE INVENTION

To achieve the foregoing, the present invention provides a speaker system that is adaptable to the listening environment while reducing distortion products in the listening axis.

The speaker system includes a satellite speaker with a side firing low mid driver. The side-firing driver is mounted in a first sub-enclosure (chamber) which is vented into a second sub-enclosure through a resistively damped port (vent). A second vent with a variable aperture size acoustically couples the first sub-enclosure to a third sub-enclosure. The vents further serve as pivots to allow the side-firing speaker drivers to be rotated through an angular range while simultaneously varying the aperture of the second vent. The pivots are isolated by o-rings to provide an airtight seal to the sub-enclosures, as well as to provide vibration control. Third, fourth and fifth resistively damped vents allow the first, second, and third sub-enclosures to establish acoustic communication with the ambient environment. A front firing driver(s) that reproduces the mid and high frequency bands is mounted in a fourth sub-enclosure.

In accordance with one embodiment, a speaker system having a main chamber with a driver mounted therein is provided. A second chamber is acoustically coupled to the main chamber by a first vent. A third chamber is acoustically coupled to the main chamber using a second vent. Each of the main, second, and third chambers include a vent to the ambient space. Each of the first vent and the second vent are configured to enable the main chamber to pivot relative to the positions of the second and third chambers.

In accordance with another embodiment, a loudspeaker system includes a main chamber housing a driver firing in substantially a side or lateral direction relative to the axis between the speaker system and the listener (the listener axis). The system also includes a second chamber and a third chamber, each acoustically coupled to the main chamber. The main chamber is configured to pivot relative to both of the second and third chambers. The speaker system is configured such that the acoustic properties of the main chamber vary in response to the pivoting movement, i.e., the rotation of the main chamber relative to the third chamber.

These and other features and advantages of the present invention are described below with reference to the drawings.

DETAILED DESCRIPTION OF PREFERRED EMBODIMENTS

Figure 1:
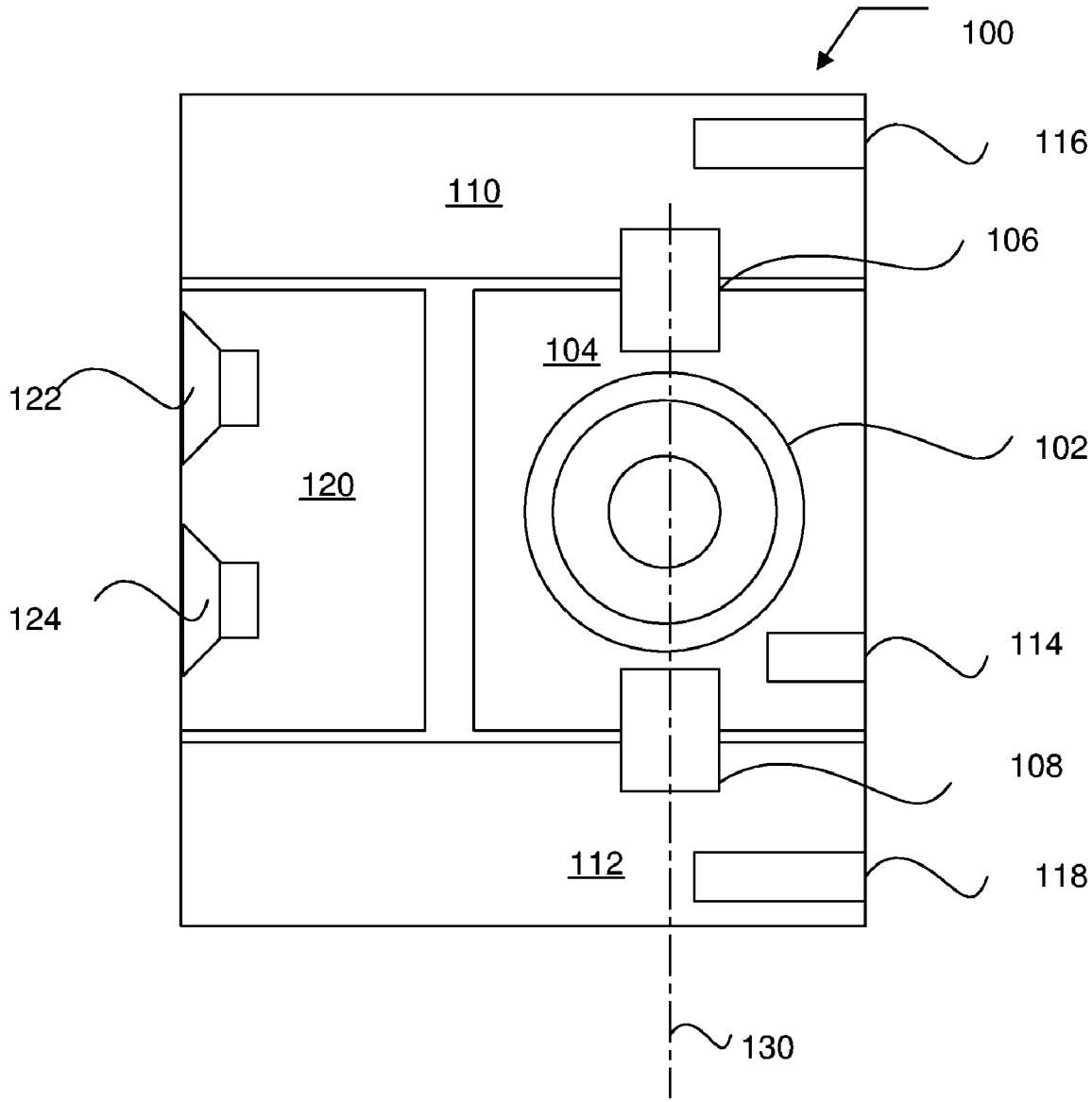
FIG. 1 is a diagram illustrating an elevation view of a speaker system in accordance with one embodiment of the present invention.

Reference will now be made in detail to preferred embodiments of the invention. Examples of the preferred embodiments are illustrated in the accompanying drawings. While the invention will be described in conjunction with these preferred embodiments, it will be understood that it is not intended to limit the invention to such preferred embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known mechanisms have not been described in detail in order not to unnecessarily obscure the present invention.

It should be noted herein that throughout the various drawings like numerals refer to like parts. The various drawings illustrated and described herein are used to illustrate various features of the invention. To the extent that a particular feature is illustrated in one drawing and not another, except where otherwise indicated or where the structure inherently prohibits incorporation of the feature, it is to be understood that those features may be adapted to be included in the embodiments represented in the other figures, as if they were fully illustrated in those figures. Unless otherwise indicated, the drawings are not necessarily to scale. Any dimensions provided on the drawings are not intended to be limiting as to the scope of the invention but merely illustrative.

In order to reduce audible distortion, embodiments of the present invention provide a loudspeaker system having front firing mid/high frequency speakers augmented with side firing speakers to cover lower frequencies. In this way, the mid/high frequency drivers are relieved of low frequency operation, and hence operate with significantly lower driver excursion and at lower average input power for the same playback volume. Typically, both thermal and nonlinear effects limit the output audio signal. Thermal compressive effects such as from heating of the voice coil of the driver are thus reduced as a result of the lower average input power. This provides an efficient audio playback while helping ensure that the mid/high drivers have an excursion limited to the linear range.

Another significant advantage from this configuration is the reduction in distortion. Distortion produced by the side firing drivers, consisting of higher frequency harmonics and noise, are effectively reduced in level at the listening position compared to a front firing setup. The orientation of the side-firing driver provides an acoustic low pass filter. That is, the driver inherently provides a narrowing dispersion of audio at higher frequencies. Hence, by orienting the low frequency driver to the side, perceived distortion is reduced. As used herein side-firing refers to a driver primarily directed in a side direction, i.e., substantially in a direction perpendicular to the listener axis between the listener and the loudspeaker system. Without intending to limit the scope of the invention, in one embodiment, the side-firing low frequency driver is primarily designed for audio reproduction covering frequencies at least in the mid-bass region, i.e., covering frequencies approximately in the 40 to 80 Hz range.

In order to accommodate changes in the speaker listening environment, a unique, adjustable acoustic loading mechanism is provided. The side-firing driver is mounted in a first sub-enclosure (a main chamber) which is vented into a second sub-enclosure through a vent. The side-firing driver is preferably mounted such that its rear surface is in contact with the enclosed air volume of the main chamber. A second vent with a variable aperture size connects the first sub-enclosure to a third acoustic chamber acoustically. The first and second vents further serve as pivots to allow the side-firing speaker to be rotated through an angular range, preferably at least +/−10 deg, simultaneously varying the aperture of the second vent. The pivots are preferably isolated by gaskets, more preferably of the o-ring type, to provide a reasonably airtight seal to the sub-enclosures (to prevent acoustic leakage), as well as to provide vibration control.

FIG. 1 is a diagram illustrating an elevation view of a speaker system in accordance with one embodiment of the present invention. The loudspeaker system 100 preferably includes a side-oriented driver 102 mounted in a main chamber 104. A first vent 106 acoustically couples the main chamber 104 to a second chamber 110. A second vent 108 acoustically couples the main chamber 104 to a third chamber 112. Third (114), fourth (116), and fifth (118) vents provide acoustic coupling between the respective main, second, and third chambers and the ambient environment. The loudspeaker system 100 also includes in the preferred embodiment a fourth chamber 120 housing one or more front firing drivers 122, 124 to reproduce mid and high frequency bands. That is, preferably, the primary audio reproduction frequency band for the front firing drivers is higher than that of the main chamber.

The multiple venting, i.e., the third (114), fourth (116), and fifth (118) vents allows the speaker to be tuned to multiple frequencies. Moreover, vent 106 and variable aperture vent 108, either alone or in combination, are also configured to contribute to tuning. Accordingly, driver 102 excursion may be reduced over a wider range than possible using conventional bass reflex enclosures. This results from the tuning of the third through fifth vents to different resonant frequencies. As known to those of skill in the relevant arts, specific tuning guidance is dependent on a variety of parameters, including the target enclosure size and the specific characteristics of the driver mounted in the main chamber 104. Accordingly, the scope of the invention is not intended to be limited to any particular tuning configuration.

Preferably, the first vent 106 is a fixed vent that simultaneously permits pivoting between the main chamber 104 and the second chamber 110. The second vent 108 is a variable aperture vent that allows fine-tuning of the enclosure's low frequency alignment. Each of the first through fifth vents is preferably resistively damped. The scope of the invention is intended to embrace all forms of resistive damping. That is, the damping may range from minimal, in which case the vents operate as Helmholtz resonators (bass-reflex ports) to full resistive damping wherein the resistive vents no longer act as resonators but instead as resistively damped ports. That is, in one embodiment, the resistively damped ports generally exhibit no characteristic resonance. As known to those of skill in the relevant arts, Helmholtz resonators are tuned to a specific frequency in order to enhance and extend the low frequency response.

In order to allow the main chamber 104 to pivot relative to the second chamber 110 and third chamber 112, the fixed aperture first vent 106 and variable aperture second vent 108 are located on a common axis 130. In a preferred embodiment, vents (apertures) 106 and 108 act as pivots and employ gaskets such as O-rings or other suitable damping mechanisms to provide an airtight seal between the respective chambers and to provide vibration control. This mechanical isolation helps avoid introduction of vibrations into adjoining chambers. Preferably, though, the first and second vents 106 and 108 simultaneously functioning as pivots are provided with elastomeric seals that pneumatically seal the joint between the pivots and the main speaker assembly and provide vibration damping as well. The scope of the invention, however, is not so limited but is intended to include any flexible washer with suitable damping and sealing characteristics. As further described with respect to FIG. 4 below, in some cases the discs forming the variable aperture vent may provide suitable sealing without additional flexible or elastomeric gaskets provided.

The scope of the invention is intended to extend to all combinations of resistive damping in the first through fifth vents. That is, for a non-limiting example, one embodiment of the invention may include lightly damped vents 114, 116, and 118 in combination with full resistive damping provided to vents 106 and 108. In such an exemplary configuration, vents 114, 116, and 118 would function as Helmholtz resonators and vents 106 and 108 would act merely as resistively damped vents or ports.

Using the three chambers and where more than one of the vents is acting as a resonator, multiple vent tuning frequencies would result. As known to those of skill in the relevant arts, the number of resulting frequencies depends on the amount of damping in each of the ports, as well as vent and enclosure dimensions. The various acoustic resistances are primarily employed as a design tool, to allow the system response to be controlled across a wide range of adjustments afforded by the variable aperture vent. By tuning the speaker system to multiple frequencies, lower driver excursion, higher sound pressure level and lower distortion is achieved in comparison to conventionally vented speakers. Variable aperture venting (e.g., vent 108) to the third chamber allows fine-tuning of the enclosure low frequency alignment, enabling the speaker to perform optimally in different positions. For example, by constricting the aperture in vent 108, the low frequency extension for the speaker system is reduced.

As known to those of skill in the relevant arts, the positioning of a speaker in a room environment affects the audio reproduction characteristics of the speaker. For example, placing a speaker closer to a room boundary such as a wall has the typical effect of boosting the low frequency content. As used herein, room boundaries include any room surfaces such as walls, floors and ceilings. Where sufficiently large objects, such as desks and other furniture, are placed near the speaker they act as an extension to these boundaries as well. The distance of the speaker to these boundaries changes the balance of the lower mid-low frequencies to the upper mid-high frequencies. Conversely, moving the speaker farther away from a wall or other boundary decreases the low frequency reproduction. In accordance with various embodiments, the resistively damped ports and enclosures are configured to provide varying levels of lower frequency augmentation to compensate for different boundary effects. Preferably, the variable aperture vent 108 is coupled with the main chamber 104 such that rotating the direction of driver 102 forwards and rearwards (by rotating the main chamber 104) respectively causes a corresponding increase or decrease in the aperture size. The configurations reflected in various embodiments enable the speaker system characteristics to be customized for the listening environment.

Figure 2:
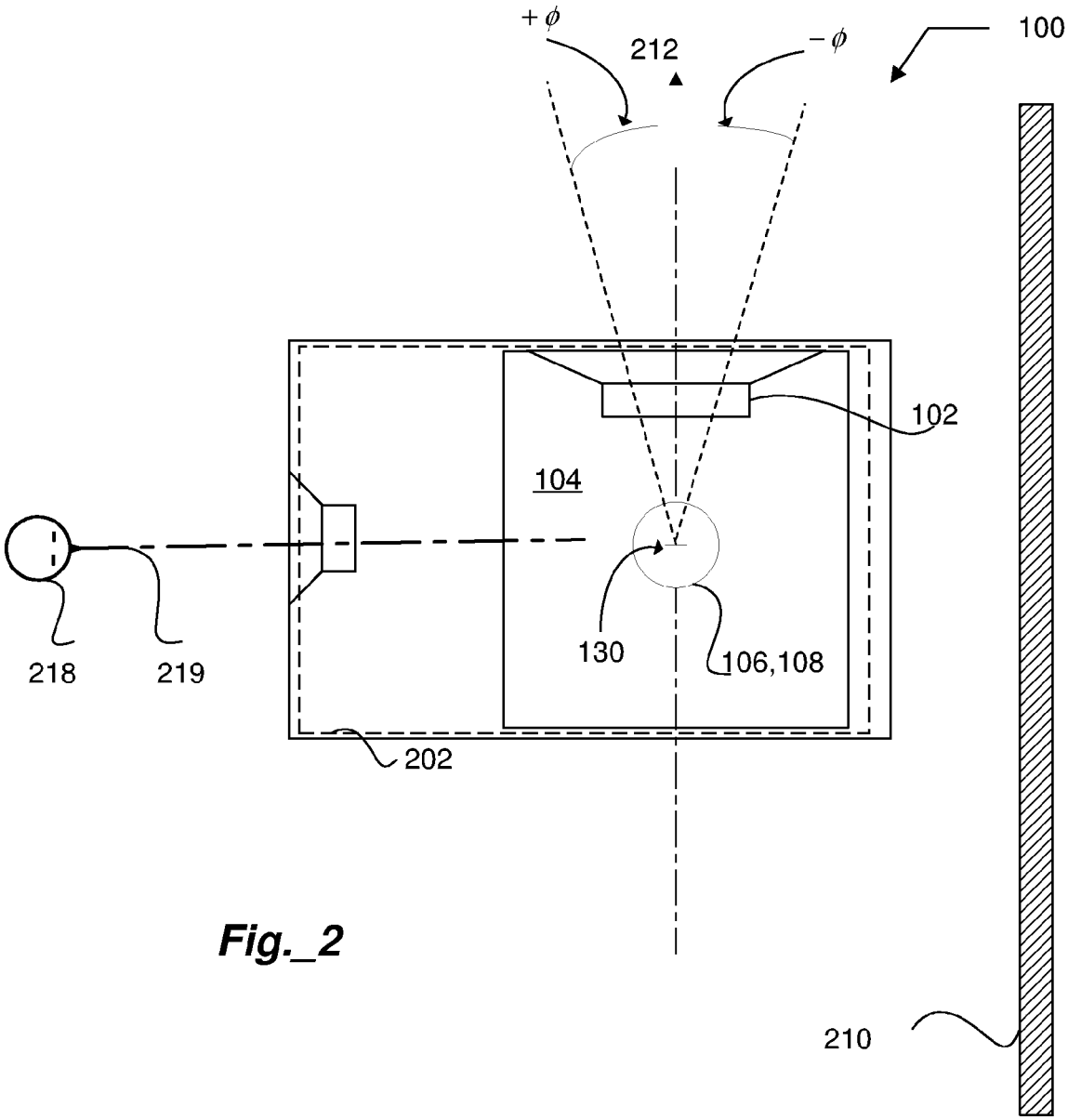
FIG. 2 is a diagram illustrating a plan view of a speaker system in accordance with one embodiment of the present invention.

FIG. 2 is a diagram illustrating a plan view of the speaker system illustrated in FIG. 1 in accordance with one embodiment of the present invention. For clarity of illustration, the second and third chambers are not shown except for the outline 202 depicting their general orientation. Main chamber 104 preferably rotates about the axis 130 formed by first vent (and pivot) 106 and second vent (and pivot) 108 (i.e., the variable aperture). In the illustrated embodiment, the pivot/vent combination is located at the geometric center of the main chamber. In alternative embodiments, the pivot/vent may be located at any other location, i.e., located eccentrically. For example, the pivot/vent may be located at eccentric locations that are also not in line with the driver axis.

Although the scope for the invention is intended to extend to any angular rotation of the main chamber relative to its adjoining chambers (i.e., second and third chambers) in accordance with one embodiment, the main chamber is configured to rotate about plus or minus ten degrees. Preferably, and in accordance with another embodiment, the main chamber is configured to rotate a minimum of plus or minus ten degrees. As will be understood by those of skill in the relevant arts, a greater range of rotation provides the potential for greater acoustic benefits.

The first vent 106 acts as a pivot and also provides a means for acoustic communication between the main (first) chamber and a second chamber within the main speaker assembly or enclosure. The second vent 108 (pivot assembly) acts as a variable aperture vent and pivot and provides a means for acoustic communication between the first chamber and a third chamber within the main speaker assembly.

The second vent 108 in one embodiment increases the aperture size when the first sub-enclosure is pivoted (swiveled) towards the front of the speaker system 100 (towards the listener-speaker system axis 219), and reduces the aperture size when the first sub-enclosure is swiveled towards the rear of the speaker system. In operation, this enhances or reduces the bass effect. For example, rotating the main chamber 104 and its driver to face rearwards (represented by a -ø angular change) constricts the aperture, causing the mid bass output of the enclosure to be increased. The attendant increase in mid bass output, as well as the rearward orientation of the side-firing (lateral firing) driver 102 renders the speaker system more suitable for placement further from the boundary (e.g., rear wall) 210 surrounding the speaker system. Conversely, rotating the main chamber 104 such that the driver 102 faces in a forward direction from the nominal side-firing direction 21 2 expands the aperture, increasing the low frequency extension and reducing mid-bass output for placement closer to boundary 210. Rotating the main chamber 104 forward also aims the driver 102 away from the rear boundary. In both cases, the orientation of the driver 102 helps to maximize the delayed time of arrival of the distortion signal as it reflects off room boundaries, as well as to reduce its magnitude at the listening position 218.

The examples provided herein of speaker orientation and placement in the room relative to boundaries are illustrative and not intended to limit the scope of the invention. It is to be appreciated that the loudspeaker system and room boundary interactions will vary in different frequency bands and is dependant on the tuning of the loudspeaker enclosures as well as the actual distances between the enclosures within the loudspeaker system and the boundary or boundaries. Accordingly, the scope of the invention is intended to include all loudspeaker systems providing an adjustable acoustic loading mechanism configured to adjust in response to a pivoting movement of the main chamber. Hence, the invention scope includes but is not limited to loudspeaker systems that increase output levels in frequency bands other than the lower midrange when the variable aperture is constricted as well as loudspeaker systems that are designed to cover only a small portion of the human audible frequency range. Further, the scope also includes adjustable vents that constrict when the driver of the main sub-enclosure is pivoted towards the front of the speaker system as well as those that provide any form of aperture adjustment in relation to movement of the coupled main chamber.

Figure 3:
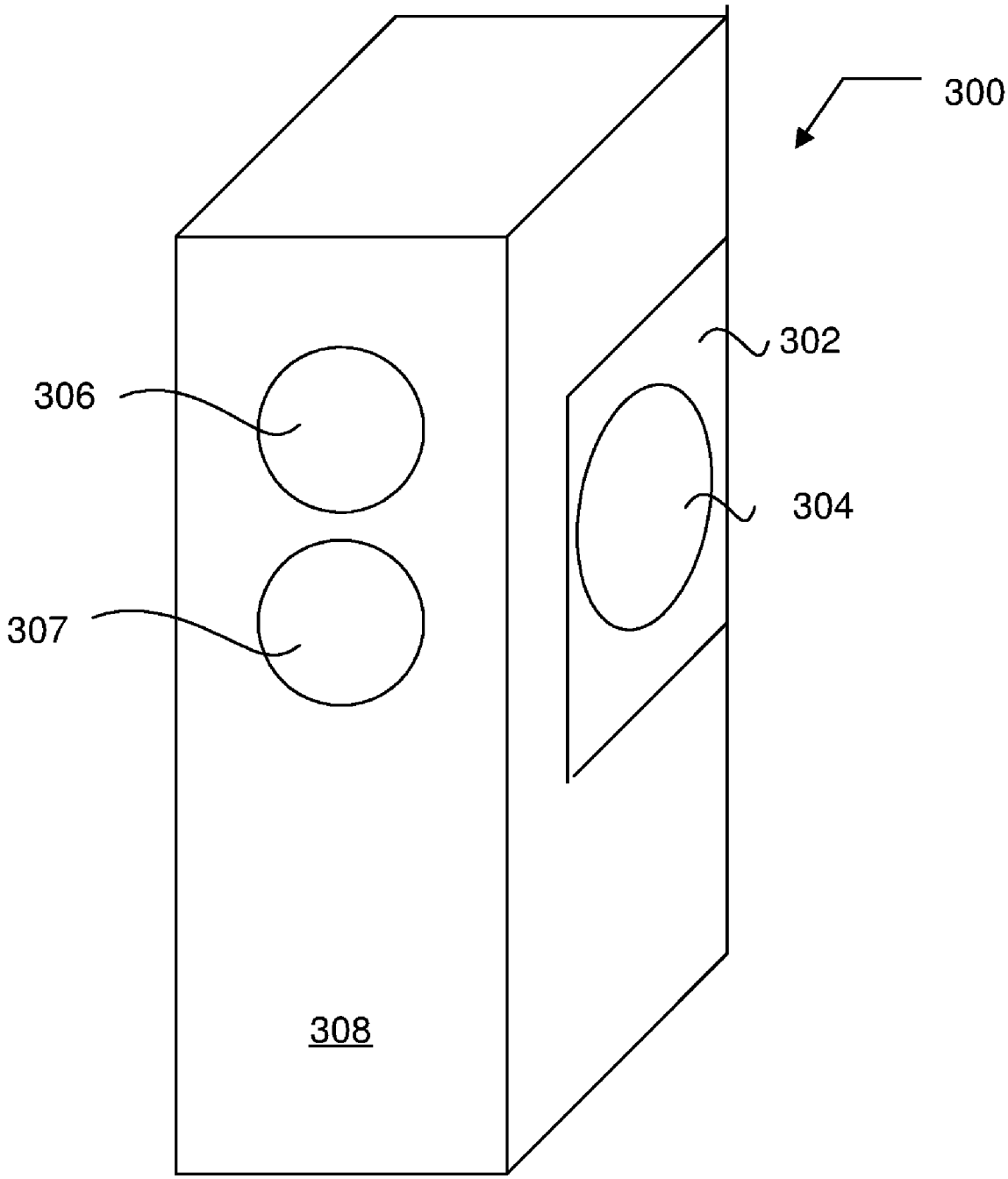
FIG. 3 is a diagram illustrating a perspective view of a speaker system in accordance with one embodiment of the present invention.

FIG. 3 is a diagram illustrating a perspective view of a speaker system 300 in accordance with one embodiment of the present invention. The main chamber 302 is shown with a driver 304 in a side-firing orientation. Although various embodiments have been described with various chambers located within a larger enclosure such as enclosure 308, the invention is not so limited. That is, the scope of the present invention is intended to extend to any configuration of speaker system having the chambers physically separated from each other and acoustically joined only by the vents. Drivers 306, 307 are front firing drivers located in a separate sub-enclosure to provide mid-high frequency playback. Preferably, the speaker system 300 as well as the speaker systems described and illustrated in the other embodiments are used in conjunction with a separate subwoofer. That is, preferably the loudspeaker system is configured such that the subwoofer primarily provides audio reproduction of the lowest frequency audio signals in conjunction with a side firing low mid and bass driver and a front firing mid high driver. The scope of the invention, however, is intended to extend to configurations of the system wherein no separate subwoofer is utilized, for example, where the lowest frequencies reproduced are provided by the side-firing driver. Preferably, the low mid driver covers bass frequencies up to the lower midrange (about 300 Hz), whereas the mid/high frequency drivers described herein generally cover the frequency range from about 300 Hz to 20 KHz.

Without in any way attempting to limit the invention and for illustrative purposes, bass frequencies generally cover a range from about 20 Hz to 160 Hz. Midrange frequencies cover the frequency range from about 160 Hz to 1300 Hz. Treble or high frequencies cover the range from about 1300 Hz to about 20 KHz.

Figure 4A:
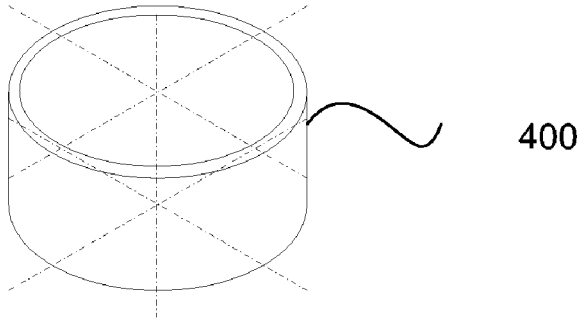
FIGS. 4A and 4B respectively illustrate perspective views of vents in accordance with one embodiment of the present invention.
Figure 4B:
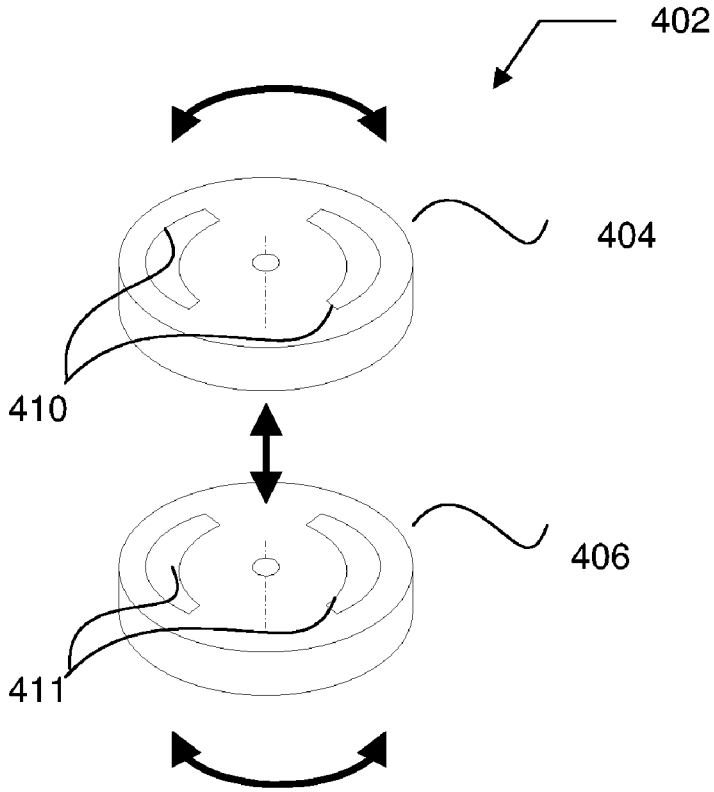

FIGS. 4A and 4B respectively illustrate perspective views of vents in accordance with one embodiment of the present invention. FIG. 4A illustrates a fixed vent 400 such as vent 106 positioned between the main chamber 104 and the second chamber 110 as illustrated in FIG. 1. That is, the fixed vent 400 may be formed from tubular material of suitable composition or by other fabrication techniques and materials as known to those of skill in the relevant arts. Techniques for providing acoustic resistance in vents are also known to those of skill in the relevant arts and hence further details will not be provided herein.

According to one embodiment, as illustrated in FIG. 4B, the variable aperture vent/pivot (e.g., vent 108 illustrated in FIG. 1) includes two adjoining discs, each of the discs including at least one slot and preferably two annular slots. Expansion and constriction of the aperture is effectuated by rotating the first disc 404 relative to the second disc 406 such that the amount of overlap between the annular slots 410-411 increases or decreases. The composition of the material is not critical, but a reasonable degree of "air-tightness" is preferable. It is preferred that the aperture is sized as a function of the actual amount of resistance needed, and is to be determined together with the other parameters of design. The first disc 404 of the adjoining discs 402 is coupled to the main chamber (104 in FIG. 1) and the second disc 406 is coupled to the third chamber (112 in FIG. 1). In this way, movement of the main chamber simultaneously causes a constriction or expansion in the aperture, allowing the tailoring of the characteristics of the speaker system to the listening environment, in particular the positioning of the speaker system relative to walls or other sound boundaries or objects located in the room. The discs 404 and 406 are configured for a stacked arrangement when assembled and form apertures of varying area when the disc 404 and 406 are rotated relative to each other. Materials used for the apertures are not limited provided that a reasonable amount of sealing is provided between discs 404 and 406. According to an alternative embodiment, disc 404 is integrally formed with the enclosure constituting main chamber 104 and disc 406 is integrally formed with chamber 112. That is, in a particular embodiment, disc 404 is molded with the enclosure forming main chamber 104 and disc 406 is molded with the enclosure forming third chamber 112.

The acoustic filtering provided by the side firing driver is primarily a function of the driver size, the enclosure dimensions, the frequency of interest and the angle between the listener and the axis of the speaker driver.

Figure 5A:
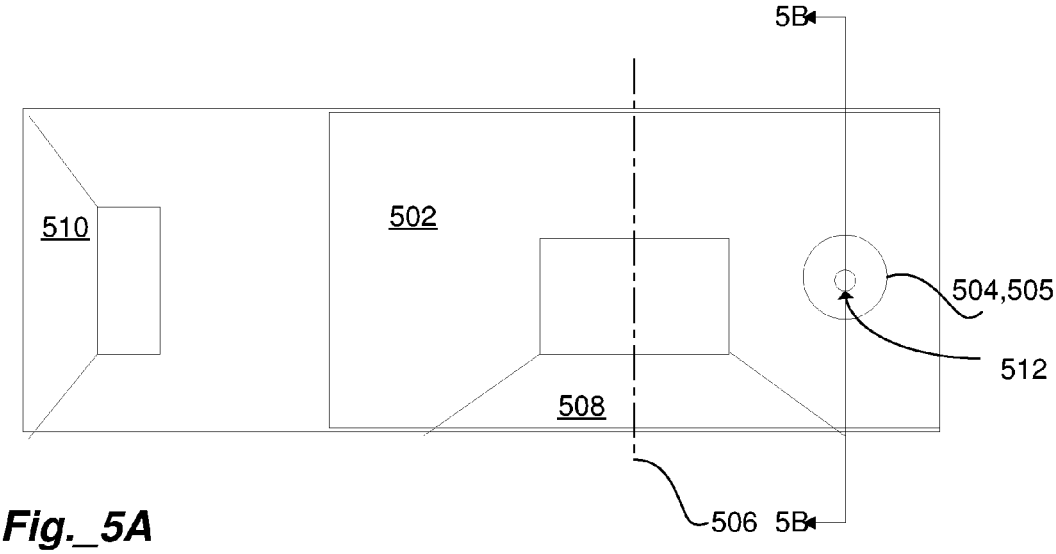
FIGS. 5A and 5B respectively illustrate plan and cross sectional views of a vent pivot mechanism in accordance with one embodiment of the present invention.
Figure 5B:
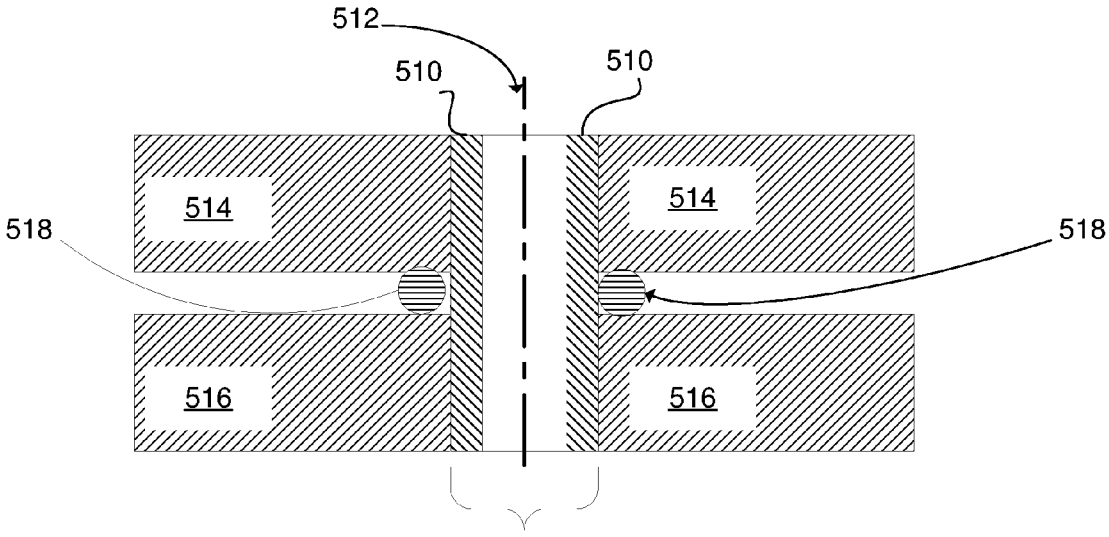

FIGS. 5A and 5B respectively illustrate plan and cross sectional views of a speaker system in accordance with one embodiment of the present invention. As illustrated in FIG. 5A, the vent-pivot mechanisms 504, 505 are located at an eccentric location in the main chamber 502. By locating the vent pivot 504 with its axis 512 at a location offset from the driver axis 506, additional torsional stress is applied to an o-ring 518 or other flexible gasket formed in the vent-pivot 504 when the side-firing speaker driver 508 vibrates. Provided that there is low friction between the tubing 510 of the vent-pivot 504 and the respective main enclosure walls 516 and second chamber 514 walls, a single o-ring 518 for the pivot assembly (vent-pivot) is expected to provide effective damping of the main chamber 502 movements relative to the second chamber and third chamber (not shown in this diagram). According to an alternative embodiment, such as might be more suitable for pivots located on or near the driver axis 506, one or more o-rings are positioned between the tubing 510 and the holes formed in the enclosure walls. This configuration is expected to provide greater compliance and damping. FIG. 5B illustrates a cross sectional view of the vent-pivot mechanism 504 shown in FIG. 5A and taken along cross sectional lines 5B—5B. Preferably the second vent-pivot mechanism (505) is a variable aperture vent constructed as shown in FIG. 4B. It is to be appreciated that the scope of the invention is to include other techniques for forming the vent-pivot and variable aperture mechanisms or assemblies and that the diagrams provided are merely illustrative of one or more embodiments.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A loudspeaker speaker system comprising:

a main chamber having a first driver; and a third chamber acoustically coupled to the main chamber by a second vent;

wherein the main chamber is pivotable about the third chamber by the second vent and the second vent is a variable aperture vent that is coupled to constrict and expand with a pivoting movement of the main chamber relative to the third chamber.

2. The loudspeaker system as recited in claim 1 further comprising a second chamber acoustically coupled to the main chamber by a first vent, wherein the main chamber is pivotable about the first and second vents relative to the second and third chambers.

3. The loudspeaker system as recited in claim 2 wherein each of the main, second, and third chambers include a vent coupled to the ambient environment.

4. The loudspeaker system as recited in claim 3 wherein the main chamber is pivotable relative to the second and third chambers in a range from 0 to at least +/− 10 degrees from a median position.

5. The loudspeaker system as recited in claim 1 wherein the main chamber is substantially oriented such that the first driver fires in a side direction perpendicular to the axis between the speaker and a listener position.

6. The loudspeaker system as recited in claim 1 further comprising a fourth chamber having a second driver mounted therein and configured for reproducing audio having a higher frequency band than the primary audio reproduction frequency band for the main chamber.

7. The loudspeaker system as recited in claim 6 wherein the fourth chamber and second driver combination is configured for reproducing audio in a mid/high frequency band.

8. The loudspeaker system as recited in claim 6 wherein the second driver mounted within the fourth chamber is configured to fire substantially along the axis between the listener and the speaker system.

9. The loudspeaker system as recited in claim 3 wherein the pivoting movement is configured to occur about a vent pivot axis and the vent pivot axis located to substantially intersect with the first driver axis.

10. The loudspeaker system as recited in claim 3 wherein the pivoting movement is configured to occur about a vent pivot axis and the vent pivot axis is located eccentrically from the first driver axis.

11. The loudspeaker system as recited in claim 3 wherein at least one of the vents are resistively damped vents.

12. The loudspeaker system as recited in claim 3 wherein at least one of the vents are Helmholtz resonators.

13. The loudspeaker system as recited in claim 1 wherein the variable aperture vent is controlled by an overlap in openings from two adjacent discs.

14. A loudspeaker system comprising:

a main chamber housing a driver firing in substantially a side direction relative to an axis between the loudpeaker system and a listener;

a second chamber acoustically coupled to the main chamber;

a third chamber acoustically coupled to the main chamber, wherein the main chamber is configured to pivot relative to both of the second and third chambers, and wherein the speaker system is configured such that the acoustic properties of the main chamber vary in response to rotation of the main chamber relative to the third chamber.

15. The loudspeaker system as recited in claim 14 wherein combination vent pivots located between the main chamber and each of the second and third chambers enables the main chamber to pivot relative to the second and third chambers and provides acoustic coupling between said chambers.

16. The loudspeaker system as recited in claim 15 wherein the combination vent pivots are formed along a pivoting axis and the pivoting axis substantially intersects the main chamber driver axis.

17. The loudspeaker system as recited in claim 15 wherein at least one combination vent pivot is a variable aperture vent configured to simultaneously vary the aperture size in response to a rotation movement of the main chamber relative to the third chamber.

18. The loudspeaker system as recited in claim 15 wherein the opening size in the variable aperture vent is controlled by the overlap in openings from two adjacent discs forming the vent.

19. The loudspeaker system as recited in claim 15 wherein the driver in the main chamber is oriented in a side firing direction relative to an intended listener and configured to reproduce lower mid and bass frequencies and the loudspeaker system further comprises a fourth chamber having a front firing second driver mounted therein and configured for reproducing mid/high frequencies.

* * * * *